US010448153B2

(12) United States Patent
Ver Valen, IV

(10) Patent No.: US 10,448,153 B2
(45) Date of Patent: Oct. 15, 2019

(54) INTERFACING A MICROPHONE OR HEADSET WITH MULTIPLE COMPUTING DEVICES

(71) Applicant: Cisco Technology, Inc., San Jose, CA (US)

(72) Inventor: Henry Clay Ver Valen, IV, Campbell, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 15/849,970

(22) Filed: Dec. 21, 2017

(65) Prior Publication Data

US 2018/0367894 A1 Dec. 20, 2018

Related U.S. Application Data

(60) Provisional application No. 62/522,312, filed on Jun. 20, 2017.

(51) Int. Cl.
*H04R 3/00* (2006.01)
*H01R 43/26* (2006.01)
(Continued)

(52) U.S. Cl.
CPC ..... *H04R 3/00* (2013.01); *H01R 43/26* (2013.01); *H01R 24/58* (2013.01);
(Continued)

(58) Field of Classification Search
CPC .. H04R 3/00; H04R 2420/01; H04R 2420/03; H01R 24/58; H01R 2105/00; H01R 2107/00
(Continued)

(56) References Cited

U.S. PATENT DOCUMENTS 8,971,546 B2 * 3/2015 Millington ..... H04L 12/282 381/77
9,025,789 B2 * 5/2015 Yamkovoy ..... H04R 5/04 381/119
(Continued)

FOREIGN PATENT DOCUMENTS

CN 1859813 B 10/2010
JP H10290128 10/1998

OTHER PUBLICATIONS

"Android—stream live mic audio from one device to multiple devices via WiFi", https://stackoverflow.com/questions/44060977/android-stream-live-mic-audio-from-one-device-to-multiple-devices-via-wifi, 1 page, Accessed Sep. 7, 2017, stackoverflow.com.
(Continued)

*Primary Examiner* — Disler Paul
(74) *Attorney, Agent, or Firm* — Behmke Innovation Group LLC; James Behmke; Stephen D. LeBarron

(57) ABSTRACT

In one embodiment, a circuit includes an audio jack that receives a connector of an external transducer. The circuit also includes an amplifier coupled to the audio jack and configured to amplify a signal associated with the external transducer. The circuit further includes a plurality of connection lines coupled to the amplifier and configured to relay the signal between the amplifier and a plurality of audio jacks of independent computing devices. The circuit additionally includes one or more resistors that provide resistance to each of the connection lines. A resistance of a particular one of the connection lines is sufficient to cause the computing device coupled to the particular connection line to recognize the particular connection line as an external transducer.

20 Claims, 9 Drawing Sheets

(51) Int. Cl.
*H01R 24/58* (2011.01)
*H01R 107/00* (2006.01)
*H01R 105/00* (2006.01)

(52) U.S. Cl.
CPC ..... *H01R 2105/00* (2013.01); *H01R 2107/00* (2013.01); *H04R 2420/01* (2013.01); *H04R 2420/03* (2013.01)

(58) Field of Classification Search
USPC ..... 381/74–83, 55, 58–59, 120
See application file for complete search history.

(56) References Cited

U.S. PATENT DOCUMENTS

| | | | | |
|---|---|---|---|---|
| 9,100,757 | B2 | 8/2015 | Johnson et al. | |
| 9,148,722 | B2 | 9/2015 | Howlett et al. | |
| 9,439,014 | B2 | 9/2016 | Yeh et al. | |
| 2016/0262717 | A1* | 9/2016 | Smith | A61B 5/0022 |
| 2018/0070187 | A1* | 3/2018 | Drinkwater | G06F 3/165 |
| 2018/0132040 | A1* | 5/2018 | Hanes | H04R 5/04 |

OTHER PUBLICATIONS

"Understanding Dante Flows", http://shure.custhelp.com/app/answers/detail/a_id/6302/~/understanding-dante-flows, 4 pages, Accessed on Sep. 7, 2017, Shure Incorporated.

* cited by examiner

INTERFACING A MICROPHONE OR HEADSET WITH MULTIPLE COMPUTING DEVICES

RELATED APPLICATION

This application claims priority to U.S. Provisional Patent Appl. No. 62/522,312 filed on Jun. 20, 2017, entitled INTERFACING A MICROPHONE OR HEADSET WITH MULTIPLE COMPUTING DEVICES, by Henry Clay Ver Valen, IV, the contents of which are incorporated herein by reference.

TECHNICAL FIELD

The present disclosure relates generally to computer networks, and, more particularly, to interfacing a microphone or headset with multiple computing devices.

BACKGROUND

Various types of computing devices allow for the connection of an analog microphone and/or headset, to receive audio input data from a user and/or to provide audio output data to the user. However, if an individual wishes to work with more than one of these computing devices simultaneously while operating a given headset and/or microphone, the user is typically required to switch out the headset or microphone that they are currently using or switch the cable between devices connecting the headset or microphone.

BRIEF DESCRIPTION OF THE DRAWINGS

The embodiments herein may be better understood by referring to the following description in conjunction with the accompanying drawings in which like reference numerals indicate identically or functionally similar elements, of which.

DESCRIPTION OF EXAMPLE EMBODIMENTS

Overview

According to one or more embodiments of the disclosure, a circuit includes an audio jack that receives a connector of an external transducer. The circuit also includes an amplifier coupled to the audio jack and configured to amplify a signal associated with the external transducer. The circuit further includes a plurality of connection lines coupled to the amplifier and configured to relay the signal between the amplifier and a plurality of audio jacks of independent computing devices. The circuit additionally includes one or more resistors that provide resistance to each of the connection lines. A resistance of a particular one of the connection lines is sufficient to cause the computing device coupled to the particular connection line to recognize the particular connection line as an external transducer.

Description

A computer network is a geographically distributed collection of nodes interconnected by communication links and segments for transporting data between end nodes, such as personal computers and workstations, or other devices, such as sensors, etc. Many types of networks are available, ranging from local area networks (LANs) to wide area networks (WANs). LANs typically connect the nodes over dedicated private communications links located in the same general physical location, such as a building or campus. WANs, on the other hand, typically connect geographically dispersed nodes over long-distance communications links, such as common carrier telephone lines, optical lightpaths, synchronous optical networks (SONET), synchronous digital hierarchy (SDH) links, or Powerline Communications (PLC) such as IEEE 61334, IEEE P1901.2, and others. In addition, a Mobile Ad-Hoc Network (MANET) is a kind of wireless ad-hoc network, which is generally considered a self-configuring network of mobile routers (and associated hosts) connected by wireless links, the union of which forms an arbitrary topology.

Figure 1A:
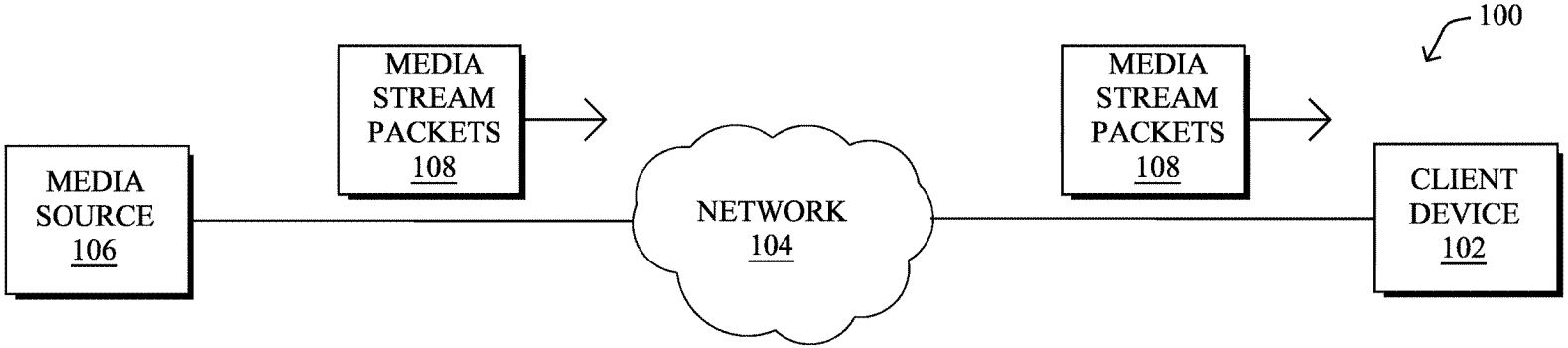
FIGS. 1A-1B illustrate an example computer system.

FIG. 1A illustrates an example computer system 100, according to various embodiments of the present disclosure. As shown, a client device 102 may be in communication with a media source device 106 via one or more computer networks 104. Media source device 106 provides media stream packets 108 through network(s) 104 to client device 102. As will be appreciated, network(s) 104 may include, but are not limited to, local area networks (LANs), wide area networks (WANs), the Internet, cellular networks, infrared networks, satellite networks, or any other form of data network configured to convey data between computing devices. Further, while media streaming is used herein to describe the techniques herein, this is but one use case and the techniques can also be used for other types of data streams in further embodiments.

Network(s) 104 may include any number of wired or wireless links between client device 102 and media source device 106. Example wired links may include, but are not limited to, fiber optic links, Ethernet-based links (e.g., Category 5/5e cabling, Category 6 cabling, etc.), digital subscriber line (DSL) links, coaxial links, T carrier links, E carrier links, combinations thereof, or the like. Example wireless links may include, but are not limited to, near field-based links, WiFi links, satellite links, cellular links, infrared links, combinations thereof, or the like.

Client device 102 may be of any form of electronic device operable to communicate via network(s) 104. For example, client device 102 may be a desktop computer, a laptop computer, a tablet device, a smartphone, a wearable electronic device (e.g., a smart watch, a head up display, etc.), a smart television, a set-top device for a television, etc.

In general, client device 102 may be operable to receive media stream packets 108 and render the received content data on an electronic display. For example, client device 102 may execute a media streaming application that, when executed by client device 102, is configured to request streamed media, such as streaming video, audio, or both. In various embodiments, the media streaming application may be a stand-alone application or, alternatively, may be another form of application that is operable to render and display streaming media (e.g., a mobile application, etc.).

As shown in FIG. 1A, client device 102 may send a media streaming request to media source device 106 through network(s) 104. In response to receiving the request, media source device 106 may send media streaming packets 108 to client device 102 through network(s) 104. The client device may repeat the above process any number of times with the same or different media source devices, depending on the contents of streaming media.

As would be appreciated, while FIG. 1A depicts media source device 106 sending media stream packets 108 to client device 102, some implementations may also provide for client device 102 to send media stream packets 108 in the opposite direction, as well. For example, in the case of an online conference, client device 102 may send locally-captured audio and/or video to media source device 106. Said differently, while client device 102 may act as a client with respect to media source device 106, client device 102 may also act as its own media source device, in some embodiments.

Figure 1B:
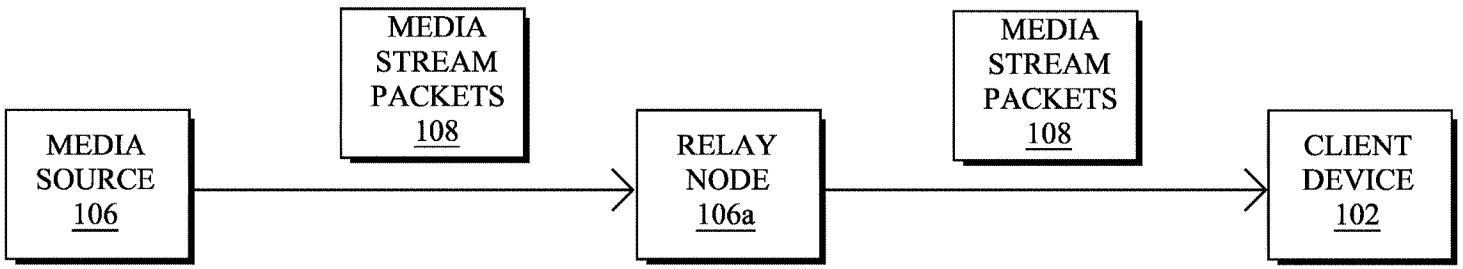

FIG. 1B illustrates another potential configuration for communication network 100, in a further example. In this example, rather than media source 106 sending media stream packets 108 directly to client device 102 via network 104, media source 106 may instead send media stream packets 108 to a relay node 106*a*. For example, relay node 106*a* may be part of a cloud-based service, such as a conferencing service or the like. Thus, in some cases, relay node 106*a* may itself be a media source from the perspective of client device 102 and may combine streams from any number of originators (e.g., audio, video, presentation, etc.).

Figure 2:
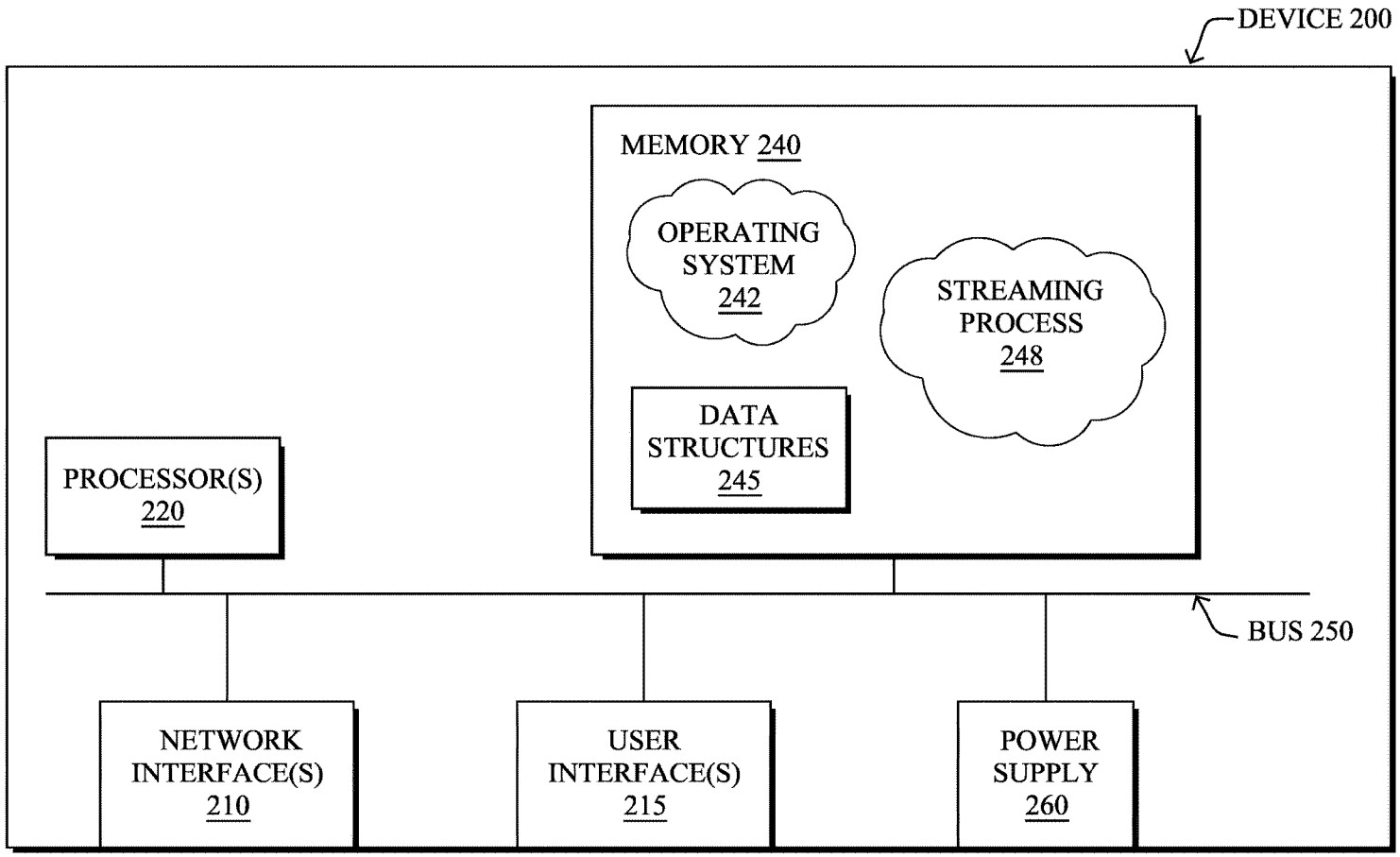
FIG. 2 illustrates an example network device/node.

FIG. 2 is a schematic block diagram of an example node/device 200 that may be used with one or more embodiments described herein, e.g., as any of the nodes shown in FIG. 1 above. In particular, device 200 may be client device 102 or media source device 106. The device may comprise one or more network interfaces 210 (e.g., wired, wireless, etc.), one or more user interfaces 215, at least one processor 220, and a memory 240 interconnected by a system bus 250, as well as a power supply 260 (e.g., battery, plug-in, etc.).

The network interface(s) 210 contain the mechanical, electrical, and signaling circuitry for communicating data to network 104. The network interfaces may be configured to transmit and/or receive data using a variety of different communication protocols. Note, further, that the nodes/devices may have two different types of network connections 210, e.g., wireless and wired/physical connections, and that the view herein is merely for illustration.

The user interface(s) 215 include the circuitry for communicating with one or more electronic components configured to receive sensory input from a user and/or provide sensory input to the user. Such sensory information may include, e.g., audio or visual information. Notably, the user interface(s) 215 may include one or more speakers, a microphone, an electronic display, a headset, or the like. Further, the user interface(s) 215 may be removable or integrated, as desired.

The memory 240 comprises a plurality of storage locations that are addressable by the processor 220 and the network interfaces 210 for storing software programs and data structures associated with the embodiments described herein. Note that certain devices may have limited memory or no memory (e.g., no memory for storage other than for programs/processes operating on the device and associated caches). The processor 220 may comprise hardware elements or hardware logic adapted to execute the software programs and manipulate the data structures 245. An operating system 242, portions of which is typically resident in memory 240 and executed by the processor, functionally organizes the device by, inter alia, invoking operations in support of software processes and/or services executing on the device. These software processes and/or services may include streaming process 248, as described herein.

It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules configured to operate in accordance with the techniques herein (e.g., according to the functionality of a similar process). Further, while the processes have been shown separately, those skilled in the art will appreciate that processes may be routines or modules within other processes.

As noted above, some systems are envisioned in which a user operating a microphone or headset may wish to operate multiple computing devices at the same time. For example, this may be the case in a virtual concierge system that can be used to connect a user to multiple endpoints using a plurality of independent computing devices such as tablet devices, telepresence devices, or the like. However, current approaches either require the user to use a different microphone or headset per computing device or, alternatively, to disconnect the microphone or headset from a first computing device and connect the microphone or headset to a second computing device.

Interfacing a Microphone or Headset with Multiple Computing Devices

The techniques herein allow a single transducer, such as a microphone or headphone set, to work with multiple computing devices simultaneously. Doing so allows for the construction of a virtual concierge system using off-the-shelf hardware that was not designed to share a single, external transducer. In some aspects, the techniques herein disclose a method of wiring the connections as analog Tip/Ring/Ring/Sleeve (TRRS) connectors using a common ground, which is typically not utilized with microphones when capturing audio on any non-computing device. Notably, in commercial recording systems, a microphone has its own ground which is not shared by any other transducer. In further aspects, the techniques herein may use resistors that function to "trick" the computing device into using the single external transducer rather than its internal one.

Illustratively, the techniques described herein may be performed by hardware, software, and/or firmware, such as in accordance with the streaming process 248, which may include computer executable instructions executed by the processor 220 (or independent processor of interfaces 210) to perform functions relating to the techniques described herein.

Specifically, in various embodiments, a circuit includes an audio jack that receives a connector of an external transducer. The circuit also includes an amplifier coupled to the audio jack and configured to amplify a signal associated with the external transducer. The circuit further includes a plurality of connection lines coupled to the amplifier and configured to relay the signal between the amplifier and a plurality of audio jacks of independent computing devices. The circuit additionally includes one or more resistors that provide resistance to each of the connection lines. A resistance of a particular one of the connection lines is sufficient to cause the computing device coupled to the particular connection line to recognize the particular connection line as an external transducer.

Figure 3C:
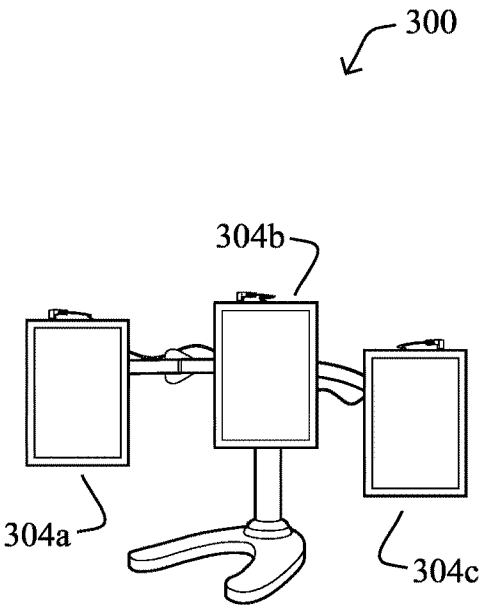
FIGS. 3A-3C illustrate examples of stands for multiple computing devices.
Figure 3B:
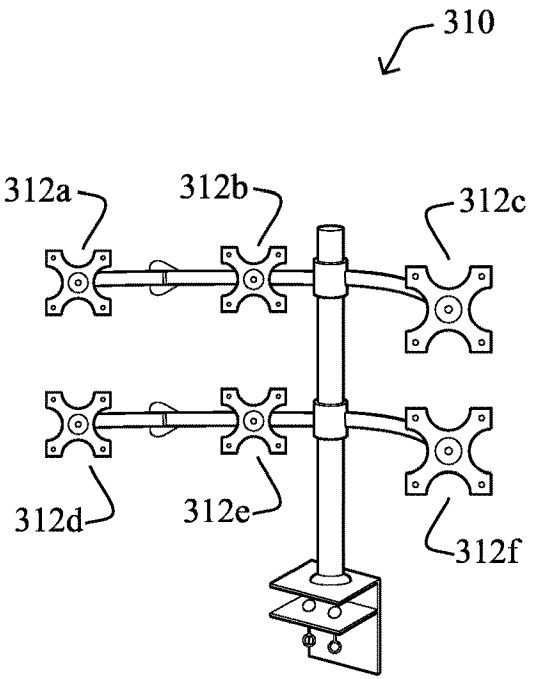
Figure 3A:
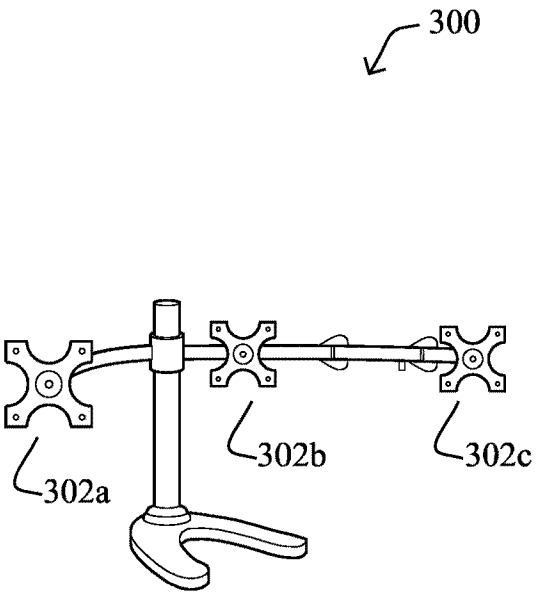

FIGS. 3A-3C illustrate examples of stands for multiple computing devices, according to some embodiments. For example, any of the stands shown may be configured for use as part of a virtual concierge service in which each of the devices supported by a given stand is connected to a different endpoint location.

FIG. 3A illustrates a stand 300 able to support up to three separate computing devices. For example, stand 300 may include mounts 302*a*-302*c*, each of which may be configured to couple with a separate computing device, such as a tablet.

FIG. 3B illustrates a stand 310 able to support up to six separate computing devices. Similar to stand 300, stand 310 may include a plurality of mounts 312*a*-312*f*, each of which is configured to couple with a separate computing device, such as a tablet.

FIG. 3C illustrates the stand 300 of FIG. 3A with three separate tablet devices 304*a*-304*c* attached. In particular, tablet device 304*a* is shown coupled to mount 302*a*, tablet device 304*b* is coupled to mount 302*b*, and tablet device 304*c* is coupled to mount 302*c*. Up to six independent computing device can be supported by mount 310 in FIG. 3B, in a similar manner.

During operation of the virtual concierge system, each of tablet devices 304*a*-304*c* shown in FIG. 3C may execute a separate telepresence sessions with different endpoint clients, thereby allowing the user of tablet devices 304*a*-304*c* to interact with different, remote users, at potentially the same time.

Figure 4B:
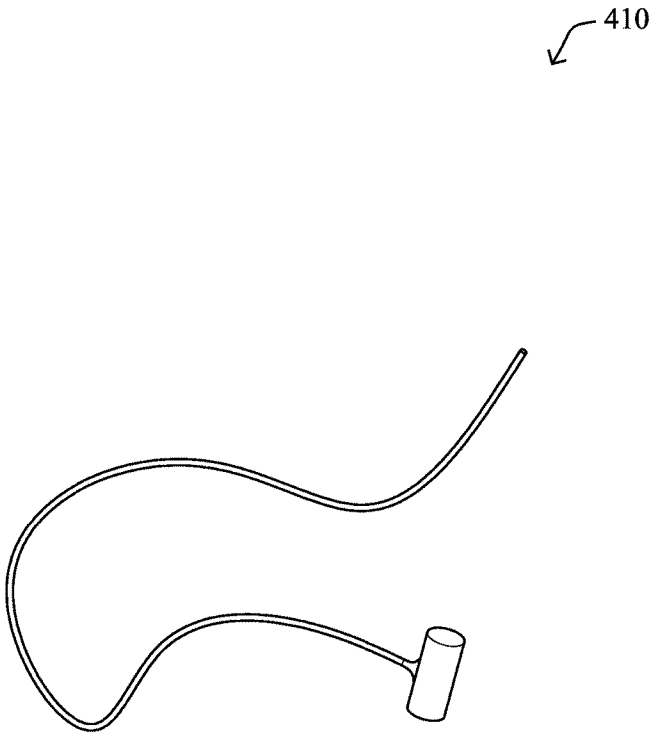
FIGS. 4A-4B illustrate example external transducers.
Figure 4A:
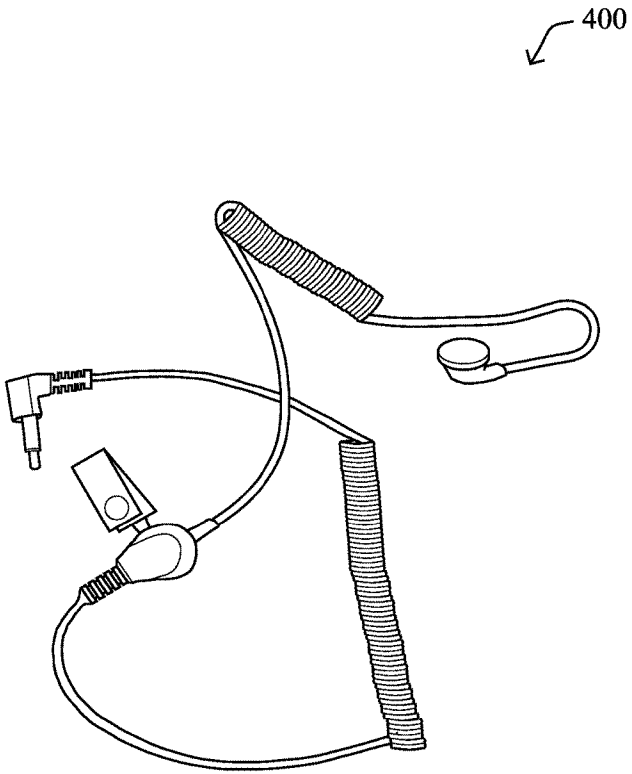

FIGS. 4A-4B illustrate example external transducers. In particular, FIG. 4A illustrates an example earbud/headset 400 that comprises a speaker and is configured to convert an electronic signal into sound waves. Similarly, FIG. 4B illustrates an example microphone 410 that is configured to convert sound waves into electronic signals for consumption by a device.

In some implementations of a virtual concierge, both an audio headset, such as headset 400, and a lavalier microphone, such as microphone 410, may be used. The headset may be used to ensure that the audio feed from one location is not picked up by the microphone and then inadvertently sent to another location. Additionally, it will reduce the chances of audio feedback loop where the audio from a given location is picked up by microphone, then sent back to the same location, where it is picked up by the microphone there and sent back, creating an echoing loop and potentially self-reinforcing resulting in a continuously louder signal being sent.

Although any headset can be used, an over the ear mono headset is recommended, such as headset 400 shown in FIG. 4A. An over the ear headset will contribute to the remote viewer having the impression that they are talking to a person that is physically present because the earpiece is almost completely hidden from their view. This is in contrast to the typical over both ears headset with a headband typically associated with call centers. Because the microphones built into tablets are both sensitive and omnidirectional, a lavalier microphone, such as microphone 410, should also be used, in a preferred embodiment. The recommended microphone is a stereo condenser microphone, although other microphone and headset types may be used, in further implementations.

In some embodiments, a stereo microphone may be desired as it can be used as part of a station with multiple computing devices, such as a station that includes any of the stands shown in FIGS. 3A-3C, depending on how the audio mixing circuit described below is wired. In one embodiment, the circuit may also supply phantom power, if condenser microphones are used. For example, depending on the type of microphone used, it may be necessary to make sure that the microphone will function properly with a phantom power supply of 24V DC.

Operationally, the techniques herein introduce a mixing circuit that allows for a single headset and/or microphone to work simultaneously with more than one computing device. It is unique because simply combining the outputs from the devices into the headsets will work for audio out, but microphone voltage levels are very small, ranging from 0.001V to 0.010V. If that is split and sent to multiple computing devices the resulting voltage level would be too low for the device to recognize. Thus, the proposed mixing box/circuit addresses the following:

1. Microphone voltage levels must be maintained. Notably, microphone level voltages (mic levels) are very small, typically ranging from 0.001V to 0.010V. Because the voltages are so small, splitting the signal from the single lavalier microphone across three or more tablets would result in voltages that are too low for the tablets to effectively work with. In order to maintain the correct voltages for the tablets a mic level distribution amplifier is needed.
2. The computing device must detect that an external transducer is connected to the device. Otherwise, by default, the computing device may use its own internal transducer, such as an internal microphone. Notably, tablet computers such as the iPad are designed to intelligently determine what the capabilities of a transducer are (i.e. headphones only, microphone only, or headphones with microphone) when it is plugged into the tablet's audio jack. It does this by testing the electrical resistance at various contact points on the jack and depending on what resistances are found will enable or disable the tablet's internal speakers and microphone. To enable the concierge workstation to work simultaneously with multiple tablets with a single headset and microphone, a custom audio mixing circuit has been developed to maintain the proper resistance settings without allowing the voltages to drop below mic level thresholds. Details of the proposed mixing circuit appear further below.

The computing device can be any device that uses electrical resistance to determine whether an external microphone is present. This includes, but not exclusively, desktop computer, laptop computers, tablet computers, smart phones, and other telepresence-capable devices.

To address (1) above, commercial microphone distribution amplifiers may be used, in some embodiments, but these types of amplifiers isolate the microphone circuit and will not result in the computing device sensing the presence of an external microphone. In such a case, the computing device will continue to use its internal microphone, which is not ideal, as these types of internal microphones are typically sensitive and omnidirectional, resulting the capture of background noise that makes the person speaking difficult to hear.

To address (2) above, the techniques herein essentially "miswire" the external microphone into an amplifier. This miswiring of microphones takes advantage of how "unbalanced" and "balanced" microphone signals are propagated. Notably, the microphones used with computing devices may have "unbalanced" signals. This means that there will only be two conductors from the microphone, a signal wire and a ground. The other type of signal that can be produced by a microphone is "balanced" and these microphones will have three conductors coming from the microphone, the signal wires and a ground. In an unbalanced microphone the signal wire and the ground wire are electrically isolated and therefore have infinite electrical resistance between them.

In a balanced microphone the two signal wires both carry a copy of the signal, but have their polarity reversed. As they carry the same signal, they are not typically electrically isolated from each other, but some minimal amount of resistance is typically found between those two signal wires (approximately 100-200 ohms). The ground wire in this case remains electrically isolated from the two signal wires.

Figure 5B:
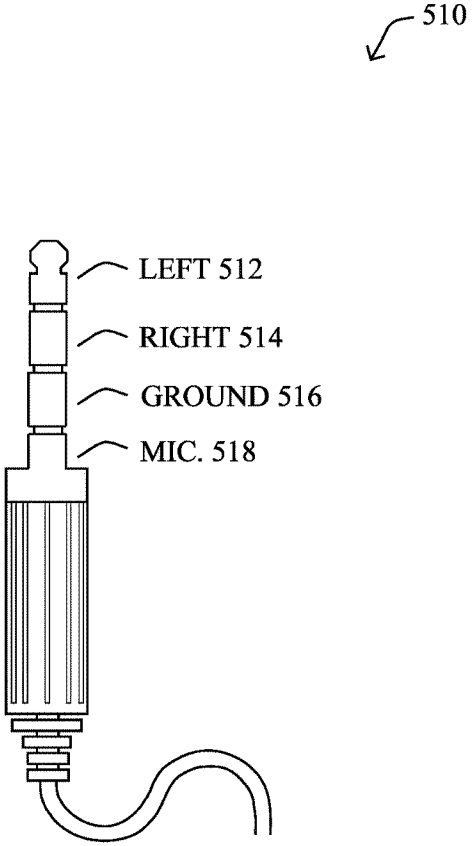
FIGS. 5A-5B illustrates example connectors for headsets and microphones.
Figure 5A:
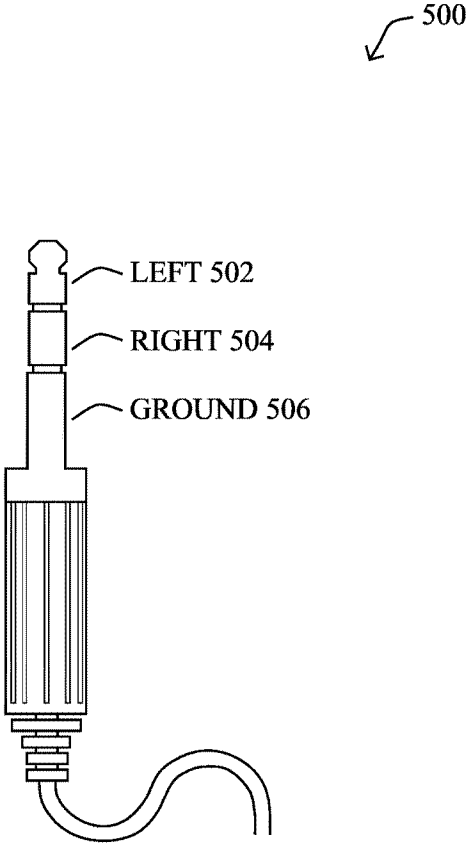

More specifically, headphone only plugs have 3 pole plugs with a Tip/Ring/Sleeve (TRS) connector and headphones with a microphone have 4 pole plugs with a Tip/Ring/Ring/Sleeve (TRRS) connector. FIG. 5A illustrates a TRS plug 500 with electrical connections 502-506 that correspond to a left speaker connection, a right speaker connection, and a ground connection, respectively. FIG. 5B illustrates a TRRS plug 510 with electrical connections 512-518 that correspond to a left speaker connection, a right speaker connection, a ground connection, and a microphone connection, respectively.

Typically, the audio jack of a computing device is a TRRS type, so when a headphone only device with a TRS plug is placed into it, both the ground and microphone contacts in the jack contact the ground (or sleeve) of the TRS plug. This results in 0Ω of resistance between the two conductors in the audio jack, which the computing device senses and, in turn, leaves its internal microphone enabled.

When a TRRS plug is plugged into the jack, the computing device notes the resistance between the ground and microphone contacts and if it is within a certain range it decides that there is a microphone present on the device that was plugged in and disables the internal microphone. The range is important because if the resistance too high the tablet will determine no microphone is plugged in and keep the internal microphone enabled. For example, an approximate resistance on a typical headset was determined to be 1.7 kΩ. More generally, in various embodiments, a resistance of approximately 1.5-1.8 kΩ may be suitable to "trick" the audio jacks of most computing devices into believing that an external transducer is present on the jack and, thus, disabling its internal transducer.

In some embodiments, the computing device expecting an unbalanced microphone signal can be wired into a balanced connection by wiring the ground wire from the device into one of the two signal connections of the balanced signal feed. Doing so allows the signal to properly propagate to the device which expects expecting an unbalanced signal from a balanced output.

The significance of this "miswiring" is it allows the signal to propagate with only minimal resistance (the aforementioned 100-200 ohms). This is important as the manner in which computing devices determine if an external microphone is present is by testing the resistance between the microphone signal conductor and the common ground conductor on the plug inserted into the device. If this resistance is too low or too high, then the device will continue to use its internal microphone. The amount of resistance can vary, but it is approximately 1,700Ω, in most computing devices. By adding the appropriate resistance on the signal wire going to the computing device, the device determines that and external microphone is present and turns off its internal microphone and uses the external feed.

The combination of both miswiring a device expecting an unbalanced signal into a microphone distribution amplifier as balanced and adding back in the appropriate resistance into that circuit both allows the signal to propagate to the device and fools the device into using that incoming signal and not its internal microphone.

Figure 6A:
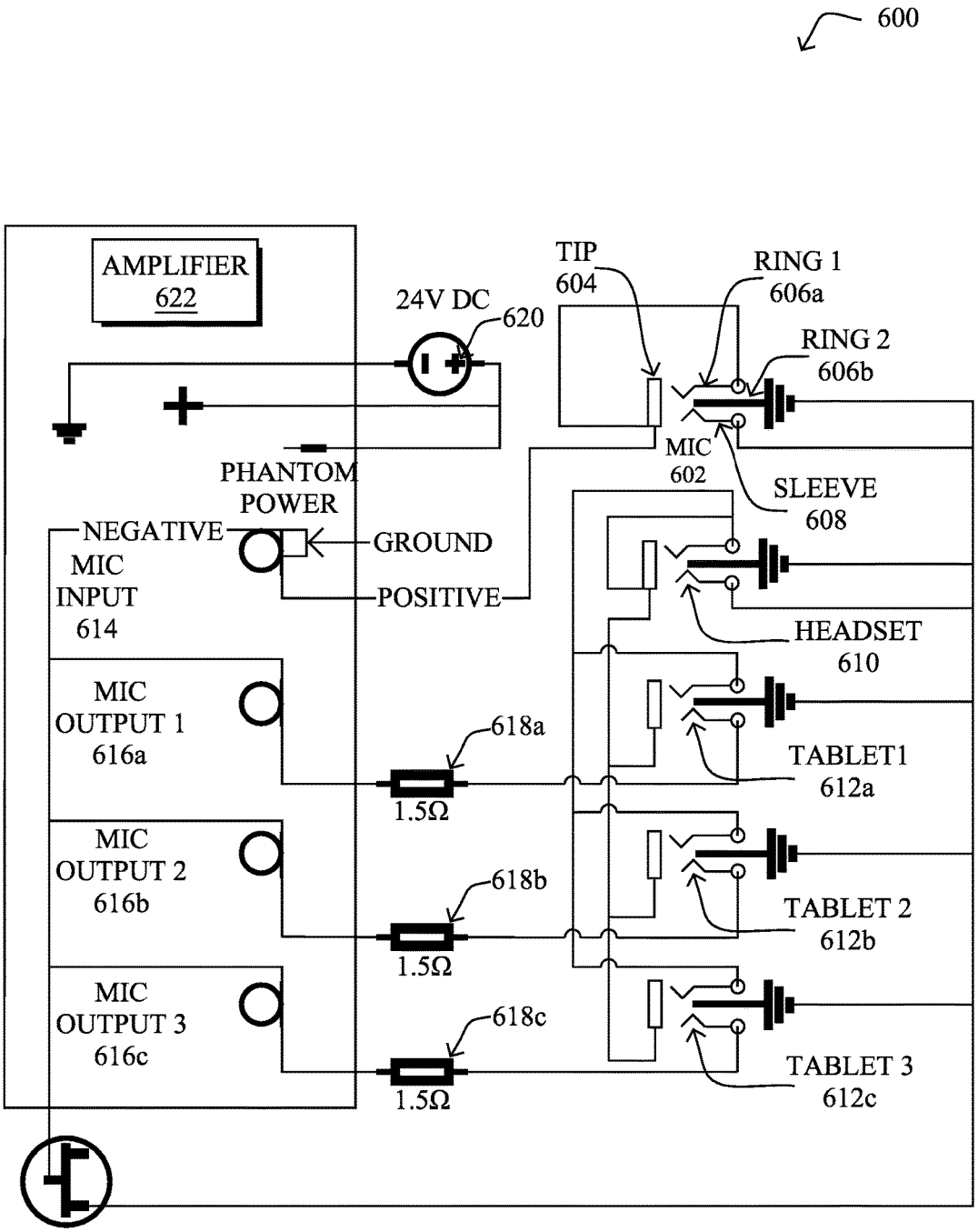
FIGS. 6A-6B illustrate example circuit diagrams for a mixing circuit.
Figure 6B:
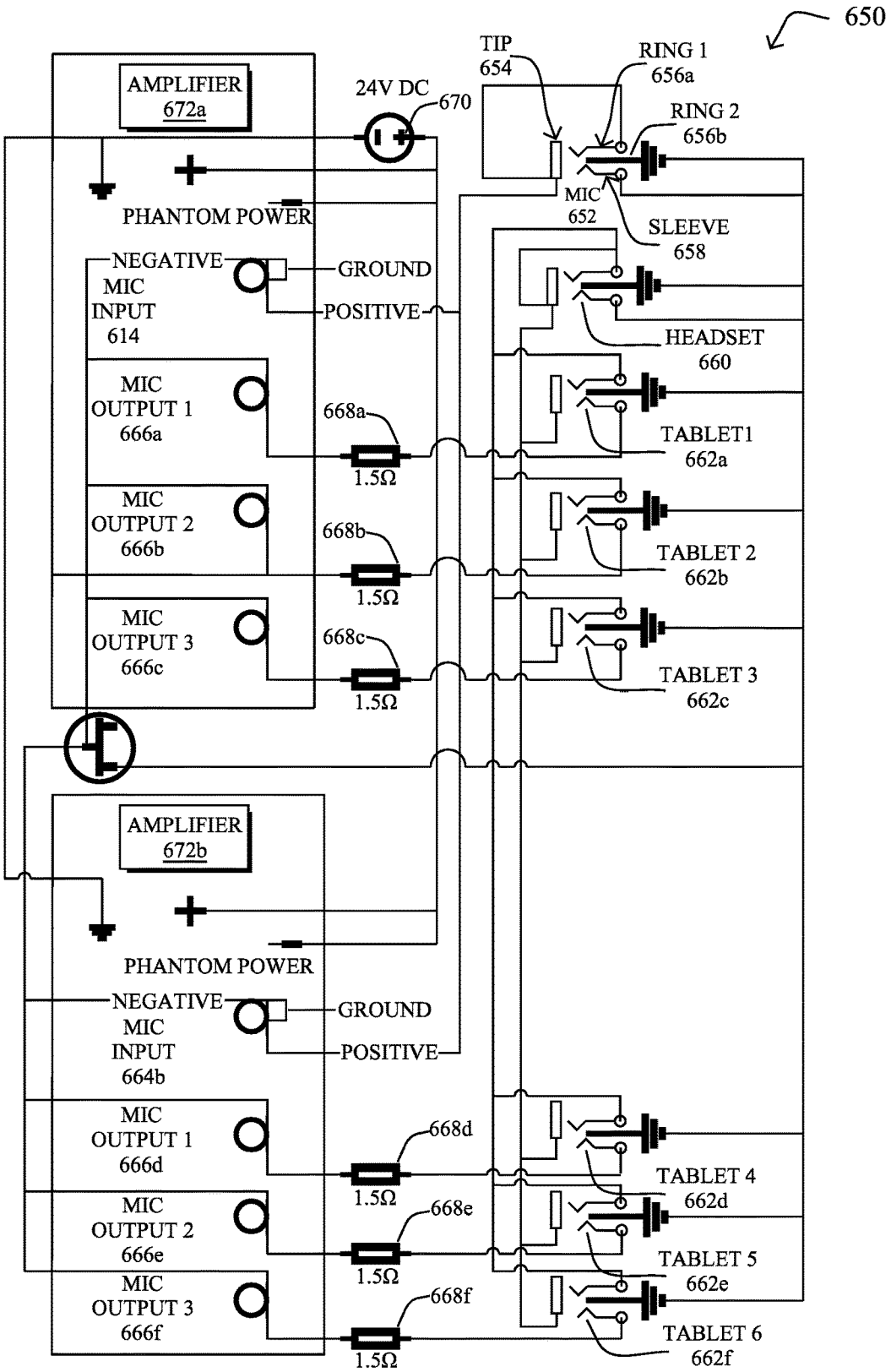

According to various embodiments, FIGS. 6A-6B illustrate example circuit diagrams for a mixing box that implements the techniques herein. More specifically, FIG. 6A illustrates a circuit diagram for a mixing circuit 600 that supports three computing devices simultaneously, in one embodiment. In another embodiment, FIG. 6B illustrates an example circuit diagram for a mixing circuit 650 that supports up to six computing devices, simultaneously.

As would be appreciated, circuits 600 and 650 shown in FIGS. 6A-6B may be adapted to support any number of computing devices simultaneously, as desired, and that the three and six device implementations shown are illustrative only. Further, while specific electronic components are shown in FIGS. 6A-6B, other components may be used in further embodiments. For example, while separate audio jacks are shown for microphone and headset connections, other embodiments may utilize only a single jack (e.g., to support a combined microphone/headset).

In FIG. 6A, circuit 600 includes a microphone jack 602 that couples with a TRRS connector of an external microphone, such as lavalier microphone 410 shown in FIG. 4B. Notably, microphone jack 602 may make separate contacts with the tip 604, first and second rings 606*a*-606*b*, and sleeve 608 of the connector of the microphone. Input signals from the microphone may be conveyed to a microphone input line 614 of an amplifier 622. Generally, amplifier 622 may be a microphone distribution amplifier. For example, amplifier 622 may be an STM-DA3 microphone level distribution amplifier from Radio Design Labs, in one implementation.

Also as shown, circuit 600 may include a headset port 610 that connects to audio jacks 612*a*-612*c* of independent computing devices, such as separate tablets. Thus, the circuit may convey the audio signals outputted by the different tablets to the external headset (e.g., earbud speaker, etc.) via headset port 610. For example, headset 400 shown in FIG. 4A may be plugged into headset port 610, to receive audio signals from the coupled computing devices.

In one embodiment, circuit 600 may also supply phantom power, if condenser microphones are used. For example, depending on the type of microphone used, it may be necessary to make sure that the microphone will function properly with a phantom power supply 620 of 24V DC.

As shown, amplifier 622 may include a number of output connection lines 616*a*-616*c* that couple to audio jacks 612*a*-612*c*, respectively. In other words, amplifier 622 may amplify an audio signal from the external microphone and convey this signal to the separate audio jacks 612*a*-612*c* of the three, independent computing devices. Notably, amplifier 622 may be coupled to lines 616*a*-616*c* that convey the amplified signal from the microphone to the respective computing devices.

Because amplifier 622 shown creates isolated microphone circuits and adds 180Ω of resistance across its positive and negative contacts, a 1.5 kΩ resistor 618 is added on each microphone output line 616, for a total of 1.68 kΩ resistance between the positive and negative connectors. This creates resistance in the proper range for the tablet or other computing device to determine that an external microphone is present and, in turn, disable its internal microphone. While a single resistor 618 is shown per line 616, other embodiments provide for multiple resistors to be used that provide combined resistance within the range needed for the corresponding computing device to recognize the line as an external transducer. In addition, resistors 618 may comprise varistors that are controllable to achieve the desired resistance, in accordance with the types of computing devices used.

Circuit 600 may also be housed within a plastic or other non-conductive box, to ensure that the cables plugged into the jacks on the box will not cause a given computing device to sense any further alteration of the resistance between the ground and microphone conductors and then enabling its internal microphone.

FIG. 6B illustrates another example embodiment of a circuit 650 configured to interface an external transducer with multiple computing devices. The operation of circuit 650 is much like that of circuit 600, but support up to six computing devices. As would be appreciated, circuits 600 and 650 are presented herein for illustrative purposes only and one skilled in the art can adapt these circuits to support any number of computing devices.

Much like circuit 600, circuit 650 in FIG. 6B includes a microphone jack 652 configured to couple with tip connection 654, ring connections 656*a*-656*b*, and sleeve 658 of a TRRS plug/connector of an external microphone, such as microphone 410 shown in FIG. 4B. Also, circuit 650 may include a headset jack 660 that can accept a plug/connector of an external headset, such as headset 400 shown in FIG. 4A.

As shown, headset jack 660 may be coupled to the audio jacks 652*a*-652*f* of six, independent computing devices, such as tablets 1-6. In contrast to circuit 600, microphone jack 652 in circuit 650 may be coupled to two amplifiers, amplifiers 672*a*-672*b*, which each provide signals from the external microphone to three of the six computing devices. Also similar to circuit 600, circuit 650 may include a power supply 670 that provides phantom power to this signal.

Output lines 666*a*-666*c* may be coupled to amplifier 672*a* and provide the amplified microphone signals to the audio ports 662*a*-662*c* of the first three computing devices, respectively. Similarly, output lines 666*d*-666*f* may be coupled to amplifier 672*b* and provide the amplified microphone signals to the audio ports 662*d*-662*f* of the next three computing devices, respectively.

Also similar to circuit 600, in various embodiments, each of the output lines 666 may be coupled to a corresponding resistor 668 that adds resistance to the line sufficient to cause the coupled computing device to recognize the line as an external microphone and disable its internal microphone. Typically, this total resistance may be approximately 1.7 kΩ for most computing devices, such as tablets, phones, etc.

Figure 7:
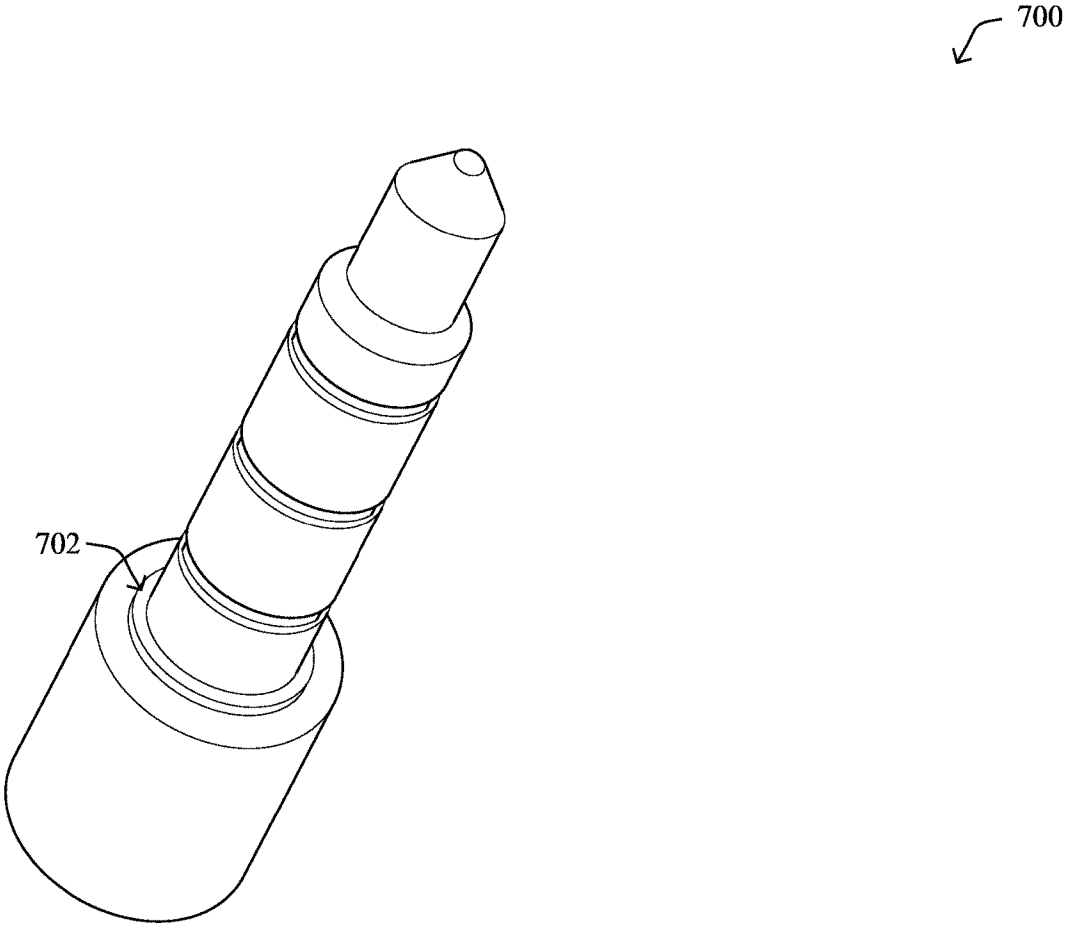
FIG. 7 illustrates an example connector.

It is also noted that care must be taken when choosing audio cabling for a virtual concierge station or other station that uses multiple independent computing devices, particularly the cables that connect to the devices. In particular, as illustrated in FIG. 7, any extra conductive material at the base 702 of the connector 700 will make contact with the frame of the tablet, which will change the resistance of the microphone line and cause the tablet to use its internal microphone and not the lavalier. Only cables with connectors that recede directly into the plug will work.

If cabling without extra material at the bottom is difficult or expensive to source, an alternative would be to create very thin (~0.1 mm) non-conductive washers which could be applied to plug. The washer must be thin to enable the jack to solidly snap into place when inserted and would need to have 3.5 mm hole to allow the plug to pass through it.

A prototype mixing circuit was constructed in accordance with the techniques herein. As noted above, audio broadcast and recording industry standards do not utilize common grounds across audio out and microphone connections (this is unique to tablets, phones, and some computers). Accordingly, the prototype had the following features:

- The unbalanced microphones were wired inside the box as though they were actually balanced to enable the resistance on the microphone lines to be adjusted.
- Proper resistances were maintained to ensure that the tablet's internal microphone remains disabled.
- The prototype circuit allowed for a single headset and microphone to work with multiple tablets simultaneously (no device currently on the market does this).

By custom wiring 3.5 mm TRRS jacks along with a Radio Design Labs-STM DA3 Mic Levels Distribution Amplifier and the proper resistors, the completed circuit enables the desired result of a single headset and microphone seamlessly working with multiple tablets simultaneously.

Figure 8:
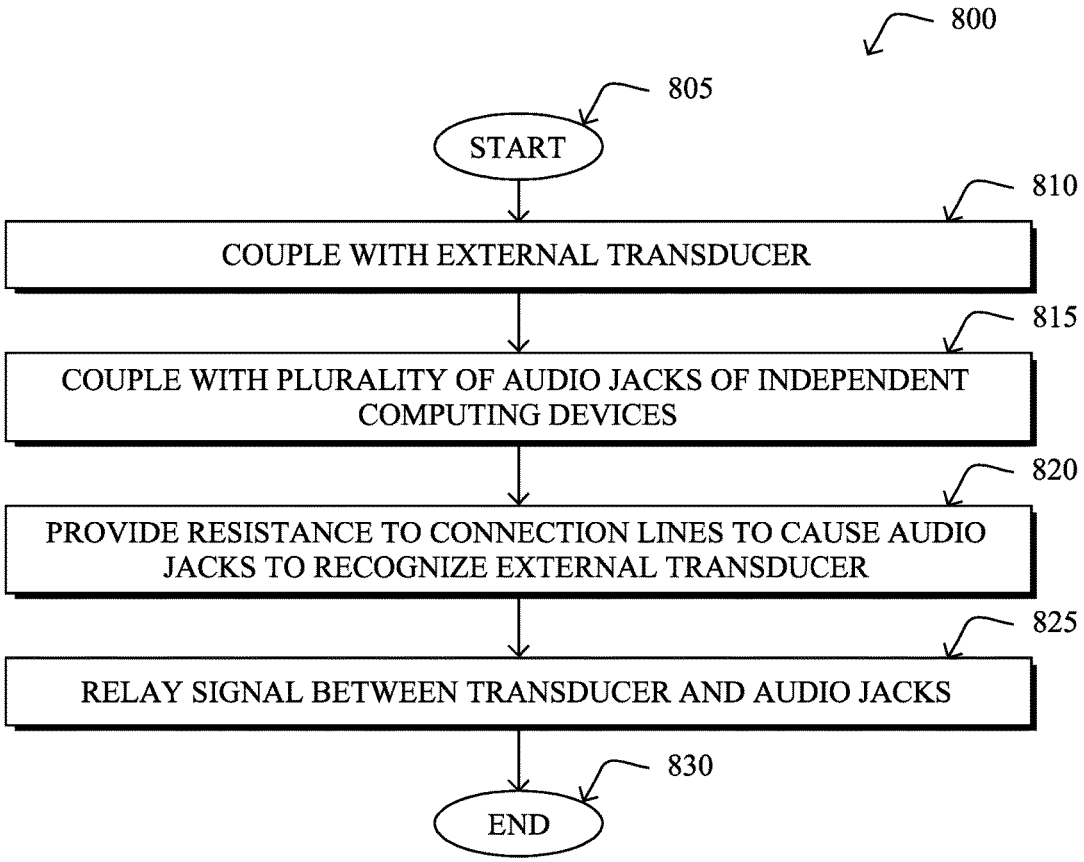
FIG. 8 illustrates an example simplified procedure for interfacing an external transducer with multiple computing devices.

FIG. 8 illustrates an example simplified procedure for interfacing an external transducer with multiple computing devices, in accordance with various embodiments. For example, a circuit constructed in accordance with the teachings herein may perform procedure 800. The procedure 800 may start at step 805 and continues on to step 810 where, as described in greater detail above, the circuit may couple with an external transducer, such as an external microphone or headset. In particular, an audio jack of the circuit may couple with a connector/plug of the microphone or headset.

At step 815, as detailed above, the circuit may also couple with a plurality of audio jacks of different, independent computing devices. Such devices may comprise, for example, separate tablet devices, telepresence devices, phones, or the like. In various embodiments, the circuit may do so via separate connection lines with the audio jacks of the computing devices.

At step 820, the circuit may provide resistance to the connection lines, to cause the audio jacks to recognize the connection lines as external transducers, as described in greater detail above. In some embodiments, the circuit may comprise one or more suitable resistors coupled to the connection lines, to provide sufficient resistance such that the computing devices believe there to be an external microphone connected. For example, in the case where the device requires a resistance in the range of 1.5-1.8 kΩ, the one or more resistors coupled to a connection line may be sized appropriately.

At step 825, as detailed above, the circuit may relay signals between the external transducer and the audio jacks of the independent computing devices. For example, in the case of an external microphone, the circuit may send the signals from the microphone to each of the computing devices. In some embodiments, the circuit may also amplify these signals, prior to sending them to the audio jacks of the devices. Procedure 800 then ends at step 830.

It should be noted that while certain steps within procedure 800 may be optional as described above, the steps shown in FIG. 8 are merely examples for illustration, and certain other steps may be included or excluded as desired. Further, while a particular order of the steps is shown, this ordering is merely illustrative, and any suitable arrangement of the steps may be utilized without departing from the scope of the embodiments herein.

The techniques described herein, therefore, allow for the use of an external transducer, such as a microphone and/or headset, by multiple computing devices, simultaneously. Doing so means that the user can still leverage the same microphone or headset to interact with the different computing devices and without having to continually swap plugs between the computing devices.

While there have been shown and described illustrative embodiments that provide for interfacing an external transducer, such as a microphone or headset, with multiple computing devices, it is to be understood that various other adaptations and modifications may be made within the spirit and scope of the embodiments herein. For example, while certain embodiments are described herein with respect to certain circuit layouts, other suitable layouts that perform a similar function could also be used. In addition, while TRS and TRRS ports are shown, these represent only illustrative embodiments, and the techniques are not limited as such. Notably, the techniques herein can also be used for any other form of port that uses resistance to sense the presence of an external transducer (e.g., Apple's Lightning Link, etc.).

The foregoing description has been directed to specific embodiments. It will be apparent, however, that other variations and modifications may be made to the described embodiments, with the attainment of some or all of their advantages. For instance, it is expressly contemplated that the components and/or elements described herein can be implemented as software being stored on a tangible (non-transitory) computer-readable medium (e.g., disks/CDs/RAM/EEPROM/etc.) having program instructions executing on a computer, hardware, firmware, or a combination thereof. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A circuit comprising:

an audio jack that receives a connector of an external transducer;

an amplifier coupled to the audio jack and configured to amplify a signal associated with the external transducer;

a plurality of connection lines coupled to the amplifier and configured to relay the signal between the amplifier and a plurality of audio jacks of independent computing devices each having an internal transducer, wherein the plurality of connection lines are cables; and one or more resistors that provide resistance to each of the connection lines, wherein the resistance provided to each of the connection lines is sufficient to cause each of the independent computing devices coupled to the plurality of connection lines to recognize the external transducer, wherein the circuit allows the external transducer to work simultaneously with more than one computing device.

2. The circuit as in claim 1, wherein the audio jack that receives the connector of the external transducer is configured to receive a Tip/Ring/Sleeve (TRS) connector or a Tip/Ring/Ring/Sleeve (TRRS) connector.

3. The circuit as in claim 1, wherein the external transducer comprises a microphone.

4. The circuit as in claim 1, wherein the external transducer comprises a headset speaker.

5. The circuit as in claim 1, wherein the resistance of the particular connection line is between 1,500 and 1,800 ohms.

6. The circuit as in claim 1, wherein the independent computing devices comprise at least one tablet or telepresence device.

7. The circuit as in claim 1, wherein the circuit has three or six connection lines.

8. A method comprising:

coupling, by a circuit, an audio jack of a circuit with a connector of an external transducer;

coupling, by the circuit, a plurality of connection lines of the circuit with audio jacks of a plurality of independent computing devices each having an internal transducer, wherein the plurality of connection lines are cables;

providing, by the circuit, resistance to each of the connection lines, wherein the resistance provided to the connection lines is sufficient to cause each of the computing devices coupled to the plurality of connection lines to recognize the external transducer; and relaying, by the circuit, a signal between the external transducer coupled to the circuit and the audio jacks of the plurality of independent computing devices, wherein the circuit allows the external transducer to work simultaneously with more than one computing device.

9. The method as in claim 8, further comprising:

amplifying, by the circuit, the signal relayed between the external transducer coupled to the circuit and the audio jacks of the plurality of independent computing devices.

10. The method as in claim 8, wherein the audio jack of the circuit is configured to receive a Tip/Ring/Sleeve (TRS) connector or a Tip/Ring/Ring/Sleeve (TRRS) connector.

11. The method as in claim 8, wherein the external transducer comprises a microphone.

12. The method as in claim 8, wherein the external transducer comprises a headset speaker.

13. The method as in claim 8, wherein the resistance of the particular connection line is between 1,500 and 1,800 ohms.

14. The method as in claim 8, wherein the independent computing devices comprise at least one tablet or telepresence device.

15. The method as in claim 8, wherein the circuit has three or six connection lines.

16. A system comprising:

a plurality of independent computing devices each including an internal transducer;

an external transducer; and a circuit comprising:

an audio jack that receives a connector of the external transducer;

an amplifier coupled to the audio jack and configured to amplify a signal associated with the external transducer;

a plurality of connection lines coupled to the amplifier and configured to relay the signal between the amplifier and a plurality of audio jacks of the independent computing devices, wherein the plurality of connection lines are cables; and one or more resistors that provide resistance to each of the connection lines, wherein the resistance provided to each of the connection lines is sufficient to cause each of the independent computing devices coupled to the plurality of connection lines to recognize the external transducer, wherein the circuit allows the external transducer to work simultaneously with more than one computing device.

17. The system as in claim 16, wherein the audio jack of the circuit is configured to receive a Tip/Ring/Sleeve (TRS) connector or a Tip/Ring/Ring/Sleeve (TRRS) connector.

18. The system as in claim 16, wherein the external transducer comprises a microphone or headset speaker.

19. The system as in claim 16, wherein the resistance of the particular connection line is between 1,500 and 1,800 ohms.

20. The system as in claim 16, wherein the independent computing devices comprise at least one tablet device.

* * * * *